US007883409B2

(12) United States Patent
Little et al.

(10) Patent No.: US 7,883,409 B2
(45) Date of Patent: Feb. 8, 2011

(54) TICKET DRAWING GAMES HAVING ESCALATING DISCRETE PRIZE LEVELS

(75) Inventors: William Little, Las Vegas, NV (US); Bryan Bullard, Las Vegas, NV (US); Daniel deWaal, Las Vegas, NV (US)

(73) Assignee: IGT, Reno, NV (US)

( * ) Notice: Subject to any disclaimer, the term of this patent is extended or adjusted under 35 U.S.C. 154(b) by 326 days.

(21) Appl. No.: 11/122,344

(22) Filed: May 4, 2005

(65) Prior Publication Data

US 2006/0252501 A1 Nov. 9, 2006

(51) Int. Cl.
*A63F 9/24* (2006.01)

(52) U.S. Cl. ..... 463/25

(58) Field of Classification Search ..... 463/17, 463/18, 19, 22, 25, 26–28, 29, 40–42; 273/269; 283/49, 903; 379/93.13
See application file for complete search history.

(56) References Cited

U.S. PATENT DOCUMENTS

| | | | | |
|---|---|---|---|---|
| 6,015,344 | A * | 1/2000 | Kelly et al. | 463/16 |
| 7,169,041 | B2 * | 1/2007 | Tessmer et al. | 463/16 |
| 2003/0032474 | A1 | 2/2003 | Kaminkow | |
| 2003/0054881 | A1 | 3/2003 | Hedrick et al. | |
| 2003/0087691 | A1 * | 5/2003 | Kiely et al. | 463/25 |
| 2003/0104853 | A1 * | 6/2003 | Tessmer et al. | 463/16 |
| 2004/0014515 | A1 * | 1/2004 | Tracy et al. | 463/17 |
| 2007/0222150 | A1 * | 9/2007 | Wright et al. | 273/269 |

FOREIGN PATENT DOCUMENTS

WO WO 2005008514 A1 * 1/2005

OTHER PUBLICATIONS

U.S. Appl. No. 11/077,241, filed Mar. 9, 2005.

* cited by examiner

*Primary Examiner*—Dmitry Suhol
*Assistant Examiner*—Malina K Rustemeyer
(74) *Attorney, Agent, or Firm*—Weaver Austin Villeneuve & Sampson LLP

(57) ABSTRACT

Ticket drawings having escalating discrete prize levels within a gaming environment are provided. A gaming system having an automated random ticket drawing game module provides ticket drawing bonus games in conjunction with primary wager based games. Ticket drawings can include base, intermediate and ultimate prize levels, with each level corresponding to a specific prize and range of ticket entries. The prize level escalates as more ticket entries are granted. Ticket entries can be awarded for various events, such as a 3-of-a-kind at a primary wager based game. Drawings include a time period for the acceptance of ticket entries, including a predefined start and end. Award and drawing mechanisms and multiple display devices facilitate each drawing. Multiple drawings can occur simultaneously, such as an hourly and daily drawing. Drawings may also be part of an ongoing series of continuous ticket drawings, such as 24 hourly drawings in a given day.

35 Claims, 6 Drawing Sheets

TICKET DRAWING GAMES HAVING ESCALATING DISCRETE PRIZE LEVELS

TECHNICAL FIELD

The present invention relates generally to ticket drawings, and more specifically to automated ticket drawing bonus games within gaming environments and associated with wager based gaming machines and systems.

BACKGROUND

As technology in the gaming industry progresses, traditional mechanically driven reel slot machines are being replaced and/or supplemented with electronic counterparts having various video displays, as gaming machines such as video slot machines and video poker machines are becoming increasingly popular. Part of the reason for their increased popularity is the nearly endless variety of games that can be implemented on gaming machines utilizing advanced electronic technology. In some cases, newer gaming machines are utilizing computing architectures developed for personal computers. These video and electronic gaming advancements enable the operation of more complex and entertaining games that would not otherwise be possible on mechanical-driven gaming machines, and thus allow the capabilities of the gaming machine to evolve with advances in the personal computing industry.

Typically, a gaming machine includes a master gaming controller ("MGC") that controls various combinations of devices that allow a player to wager on and play a wager based game on the gaming machine, as well as to generally encourage game play on the gaming machine. For example, a game played on a gaming machine usually requires a player to input money or indicia of credit into the gaming machine, indicate a wager amount, and initiate a game play. These steps require the gaming machine to accept player credit from various intake devices, such as bill validators and coin acceptors, to recognize user inputs from various input devices, including handles, touch screens, buttons and the like, and to determine the wager amount and initiate game play. After game play has been initiated, the gaming machine typically determines a game outcome, presents the game outcome to the player and may dispense an award of some type, possibly including a monetary award, depending on the outcome of the game. A game outcome presentation may utilize many different visual and audio components such as flashing lights, music, sounds and graphics. The visual and audio components of the game outcome presentation may be used to draw attention to various game features and to heighten interest in additional game play. Capturing and maintaining interest in game play, such as on a gaming machine or during other gaming activities, is an important consideration for an operator of a gaming establishment.

One well known method of gaining and maintaining player interest in game play on gaming machines, table games and other sources of gaming activity is to provide a player rewards or loyalty point program, such as one of the many player rewards and tracking programs offered at a variety of casinos. Various actual player rewards programs include, for example, the "Player's Club," "Boarding Pass," "Total Rewards®" and "One Club" programs, among others. These and other similar player rewards or loyalty point programs provide rewards to players that tend to correspond to the level of patronage of the players (e.g., to playing frequency and/or total amount of game plays or wagers at a given casino). Various loyalty point or player rewards may include, for example, free or reduced price meals, lodging, entertainment, or merchandise, among other items. Monetary awards and/or free or special game plays may also be provided. These rewards may help to sustain player interest in additional game play during a visit to a gaming establishment, and may also entice a player to visit or return to a gaming establishment to partake in various gaming activities.

In general, loyalty programs may be applied to any game of chance offered at a gaming establishment, and such programs are generally implemented using a player tracking system, as is well known in the art. Such a player tracking system can include a central server and database, as well as a plurality of associated player tracking units or devices provided at various gaming machines, terminals and other program sponsoring locations. Such player tracking units or devices are preferably adapted to accept player identifying indicia, such as magnetic stripe player tracking cards or other similarly suitable player identifiers. A player tracking device typically contains at least a card reader, a keypad and a display, as well as a separate controller adapted to control specific player tracking functions and to communicate with the MGC of the gaming machine and the central player tracking server, as is generally known in the art. As a particular example, an MGC may employ a subset of the Slot Accounting System ("SAS") protocol developed by IGT of Reno, Nev., in order to communicate with certain kinds of player tracking units and systems. Added details of player tracking systems and loyalty point programs can be found in a variety of references, such as, for example, commonly owned U.S. patent application Ser. No. 09/927,742 by Kaminkow, entitled "Flexible Loyalty Points Programs," which is incorporated herein by reference in its entirety and for all purposes.

Another known method of gaining and maintaining player interest in a gaming environment, such as in game play on gaming machines, table games and other sources of gaming activity, is to provide promotional ticket drawings or raffles. Such events typically involve players earning or being awarded ticket entries to a ticket drawing where a prize is given to the holder of a winning ticket drawn from all of the ticket entries. Such prizes can include cars, vacations, lodging, show tickets or passes, food, merchandise and other items, as well as straight cash prizes. Players or patrons can earn or be awarded ticket entries for a variety of activities and events, and may in some instances be provided with ticket entries simply for signing up.

Although such ticket based drawings can be useful in that they do tend to generate interest amongst patrons, game players and potential patrons and game players, there are a number of drawbacks to such approaches. For one thing, the prize or prizes for a typical ticket drawing tend to be set well in advance. This can result in the award of a prize that is not commensurate with the level of player participation or interest that the ticket drawing was intended to generate. Where levels of interest and participation exceed expectations of the ticket drawing promoter or provider, this may not be an issue. Where interest and participation levels fall short of expectations, however, then the ticket drawing promoter or provider may take a significant loss with respect to the prize or prizes that were provided. For example, a given gaming operator may provide a ticket drawing promotion having a grand prize of a new car, where the expectation is that such a prize should generate enough interest and/or player participation to result in 10,000 ticket entries to the drawing. In the event that only 4000 ticket entries are actually created and put into the drawing, then the level of actual interest and participation has fallen far short of that which was expected, resulting in a likely net overall loss to the gaming operator. Such disappointing results can and do happen, such that the creation and advertisement of a promotional ticket drawing having one or more guaranteed prizes has at least this drawback.

In addition, many forms of ticket based drawings are manual in nature, such that most or every ticket entry is created on a separate ticket, sheet of paper or other physical item, whereupon it is placed into a hopper or bin with all of the other submitted ticket entries. Not only do such manual systems and methods require a significant amount of time and effort on the part of the ticket drawing promoter, but they are also susceptible to error and fraud. Ticket entries may be distributed in error, such as by an employee who does not fully understand the rules of the ticket drawing and how entries are to be properly awarded. In the case of fraud, an unscrupulous employee or other party may, for example, steal or otherwise obtain a number of tickets illegitimately, and then cause these extra tickets to be added to the bin for a potential win to himself another undeserving party. Also, the very technique of drawing a "winning" ticket manually may be susceptible to fraud or tampering by a sophisticated party or team or conspirators, depending upon the security measures and controls that may or may not be put in place by the ticket drawing sponsor.

While existing systems and methods for providing ticket based drawings have been adequate in the past, improvements are usually welcomed and encouraged. In light of the foregoing, it is desirable to develop ticket based drawings and bonus games for a gaming environment that can provide more reliable and verifiable results and procedures, and in particular for such ticket based drawings and bonus games to comprise a more transparent and auditable process and result, with prizes that are created and awarded in relation to the actual overall level of player participation.

SUMMARY

It is an advantage of the present invention to provide ticket drawings having escalating discrete prize levels, particularly in a gaming environment, such as those involving wager based gaming machines and systems. This is accomplished in many embodiments by providing within or about a gaming machine or system an automated random drawing game module, such as one that may be associated with a player tracking and rewards program. The ticket drawings, which may be in the form of bonus games used in conjunction with primary wager based games, can be used to promote player loyalty as another feature of an established player rewards or loyalty program. Other advantages include the ability to scale the prize awards to more accurately reflect the level of overall participation in a given drawing, the relative ease of administration due to the automation of the ticket drawings, and the enhanced entertainment value to players due to the various animated video sequences.

According to several embodiments of the present invention, the disclosed systems and methods involve various ticket drawings within a gaming environment including wager based games for players of such wager based games. Unlike many forms of raffles or other ticket based drawings, a variety of prize levels containing different prizes are available for any given ticket drawing. Such prize levels can include a base prize level and one or more subsequent prize levels, which may comprise intermediate prize levels and/or an ultimate prize level. Each such prize level has a corresponding prize to be awarded where the number of total ticket entries to a ticket drawing ranges from a minimum threshold number of ticket entries to a maximum threshold number of ticket entries. For the base prize level, the minimum threshold number can be one ticket entry, while for the ultimate prize level, the maximum threshold can rather be an unlimited maximum number of ticket entries.

Ticket drawings can be fully automated in every regard, or can have one or more components conducted manually, as desired. Various automated aspects can be conducted and shown in a computer created and enhanced virtual environment. Each ticket drawing or ticket drawing bonus game can include a time period for the acceptance of ticket entries, with such a ticket entry period including a predefined start and a predefined end. Such a predefined and scheduled ticket entry period can be, for example, one hour, one day, one week, one month, or one year, among other time periods. One or both of the predefined start and predefined end can be scheduled for a specific date and time, and one or both of the predefined start and predefined end can be set to take place as a result of a specific triggering event, such as a player hitting a royal flush. In addition, the actual drawing for a ticket drawing bonus game can be scheduled to take place at a particular time or in response to a triggering event regardless of the number of entries at that time. For instance, the ticket drawing can take place at the same time as the end of the ticket entry period.

Ticket drawings can also have an award mechanism adapted to award ticket entries to players, a drawing mechanism adapted to facilitate the drawing of a winning ticket from all ticket entries, and a display apparatus adapted to present information regarding each ticket drawing. Ticket entries can be awarded for a wide variety of predefined player activities and/or predefined wager based game results. Particular outcomes of the primary games that can result in a ticket entry can include, for example, a 3-of-a-kind, straight, flush, full house, 4-of-a-kind, straight flush, 2 matching reel symbols, 3 matching reel symbols, 10 coin payout, 20 coin payout, 50 coin payout and 100 coin payout, among others.

Presented information can include a main screen containing information regarding the current specific prize to be awarded, the number of additional ticket entries required to advance that prize to the next prize level, the specific prize at the next prize level, and/or the predefined end of the period for the acceptance of ticket entries, such as a given date and/or time, among other items. A countdown timer may represent such a period end display. Presented information can also include a ticket entry creation animation screen a ticket prize drawing animation screen, an advertisement screen, and/or a scrolling ticker at an edge of a displayed screen, as desired. Such a scrolling ticker can provide current bonus game information. It will be understood that a wide variety of ticket drawings or ticket drawing games involving various combinations of the foregoing features can be provided, that not every such ticket drawing must contain all of these features, and that other features not disclosed herein may also be added to a given embodiment.

According to various further embodiments of the present invention, the disclosed systems and methods can include any version of the foregoing ticket drawings, and also involve a gaming machine, network and/or gaming system adapted for accepting wagers, playing primary games based on the wagers and granting monetary awards based on the results of the primary games. The gaming machine, network or system can include one or more MGCs adapted to control one or more aspects of the primary games, among various other items. In embodiments including an actual gaming machine, an exterior housing arranged to contain a plurality of internal gaming machine components can also be included. In embodiments to a gaming system, one or more gaming terminals adapted for game play can be provided, which terminals can be gaming machines.

Each gaming machine or terminal can include a player tracking device or unit that is in communication with a respective MGC, adapted to accept identification indicia from players, and/or adapted to track both player activity and primary game results at its respective gaming machine or terminal. In the case of a gaming system, an overall player tracking system may also be included, with such a player tracking system being similarly adapted to track both player activity and primary game results at each of its gaming terminals. Such player tracking devices and systems can be further adapted to facilitate the play of automated ticket drawing bonus games that can be based at least in part on the results of one or more primary game results. As in the foregoing embodiments, each automated ticket drawing bonus game can have a plurality of ticket entries and can be structured to have escalating and discrete prize levels, wherein graduation from one discrete prize level to the next prize level requires a plurality of additional ticket entries. Each gaming machine or system can also include at least one display device in communication with a respective MGC and/or player tracking device, with such a display device being adapted to display information regarding the automated ticket drawing bonus games having escalating and discrete prize levels. In addition, a gaming system can include a separate ticket drawing controller that can be within or at least in communication with the player tracking system, with such a controller being adapted to accept input, facilitate the storage of pertinent information, and generate results regarding ticket drawings.

In various detailed embodiments, the player tracking device or system can be further adapted to facilitate the play of multiple automated ticket drawing or ticket drawing bonus games having predefined and scheduled ticket entry periods that at least partially overlap. For example, a first automated ticket drawing bonus game can comprise an hourly game, while a second automated ticket drawing bonus game can comprise a daily game having a ticket entry period that starts before and ends after the entire hourly game. Also, any given ticket awarding event, such as a particular outcome of a primary game, can result in ticket entries being awarded to a player for multiple ticket drawings, such as both of the hourly and daily automated ticket drawing bonus games in the foregoing arrangement.

In addition, a given ticket drawing or ticket drawing bonus game can comprise one ticket drawing of an ongoing series of continuous ticket drawings. Under such an arrangement, one or more drawings in an ongoing series drawings can begin immediately after a prior drawing ends and can end immediately before a subsequent drawing begins. As stated, a given game or "drawing" can be said to include the entire ticket entry period as well as the actual ticket drawing itself. Where an ongoing series is continuous, a series of hourly drawings or games can take place, for example, 24 times on a particular day.

In the case of a gaming system, a plurality of display devices can be used, such as a player tracking display at each gaming machine or terminal and/or one or more additional common display screens, such as those that may be placed above a bank of gaming machines or terminals. Each such display device can be adapted to display information regarding various ticket drawings, and the overall gaming system can be configured such that different information or screens regarding the same ticket drawing or game can be displayed at different display devices simultaneously. In this regard, the display device at one gaming terminal can display one screen, such as a main display screen having ticket drawing information, at the same time that the display device at another gaming terminal is displaying a substantially different screen, such as a ticket entry creation animation screen.

In further embodiments of the present invention, various methods of facilitating a ticket drawing within a gaming environment including wager based games are provided. A first step can involve providing a gaming machine or system having at least one player tracking device and one or more displays adapted to present information regarding the play of wager based games and/or ticket drawings. Of course, the player tracking device is preferably adapted to track both player activity and wager based game results at the gaming machine or system. A subsequent step can involve establishing a ticket drawing having specifically designated prizes at escalating and discrete prize levels. Such prize levels can include a base prize level, one or more intermediate prize levels, and an ultimate prize level. As in the above embodiments, such a ticket drawing can also having a period for the acceptance of ticket entries, with such a period including a predefined start and a predefined end. A further step can be to set the initial prize of the ticket drawing at a specifically designated prize for the base prize level.

Further steps of facilitating the ticket drawing can be made with respect to a first given player, including accepting at least first one indicia of identification from the first player at the gaming machine or system, linking the first player with a first player account stored on an associated player tracking system, presenting a wager based game based on a wager tendered by the player, and awarding the first player a first ticket entry to the ticket drawing based upon the result of that wager based game, wherein the award of said first ticket entry does not result in any change in the ticket drawing prize. Additional steps can also be made with respect to a second given player, including accepting at least one second indicia of identification from the second player at the gaming machine or system, linking the second player with a second player account on the associated player tracking system, and awarding the second player a subsequent ticket entry to the ticket drawing.

Other method steps can then include resetting the ticket drawing prize from the specifically designated prize for the base prize level to the specifically designated prize for a first intermediate prize level as a result of the subsequent ticket entry to the second player, conducting the ticket drawing after the predefined period for the acceptance of ticket entries has ended, wherein a winning ticket is selected from all awarded ticket entries, and then granting an appropriate specifically designated prize to the player having the winning ticket.

Still further steps can include awarding a plurality of additional ticket entries to the ticket drawing after the awarding of the subsequent ticket entry to the second player, and then making a determination with respect to whether the prize should or should not be reset again. In one embodiment, it can be determined that the additional ticket entries do not comprise a sufficient number of ticket entries to further reset the prize. In other embodiments, the prize of the ticket drawing is indeed reset from the specifically designated prize for a first intermediate prize level as a result of the additional ticket entries. In one such embodiment, the prize is reset to a specifically designated prize for a second intermediate prize level, wherein at least one further prize level can be reached if still further ticket entries are awarded. In another such embodiment, the prize is reset to an ultimate prize level, wherein no further prize level exists beyond the ultimate prize level regardless of the number of further ticket entries that may be received.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive ticket drawing games having escalating discrete prize levels. These drawings in no way limit any changes in form and detail that may be made to the invention by one skilled in the art without departing from the spirit and scope of the invention.

DETAILED DESCRIPTION

Exemplary applications of systems and methods according to the present invention are described in this section. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following example should not be taken as definitive or limiting either in scope or setting. In the detailed description that follows, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

One advantage of the present invention is the introduction of ticket based drawings and bonus games for a gaming environment that can provide more reliable and verifiable results and procedures, as well as prizes that are commensurate to the level of player participation in the ticket drawings. This is accomplished at least in part by providing within or about a gaming machine or system an automated ticket drawing game module, such as one that may be associated with a player tracking and rewards program. The provided ticket drawings, which may be automated and which may be in the form of bonus games used in conjunction with primary wager based games, can be used to promote player loyalty as another feature of an established player rewards or loyalty program. Besides the ability to award prizes that are appropriate for the level of player participation, other advantages include the relative ease of administration, and the increased ability to audit and verify ticket entries and drawing results nature due to the automated nature of the ticket drawings. A more enhanced entertainment value can also be present due to animated video sequences.

Gaming Machines and Systems

Figure 1:
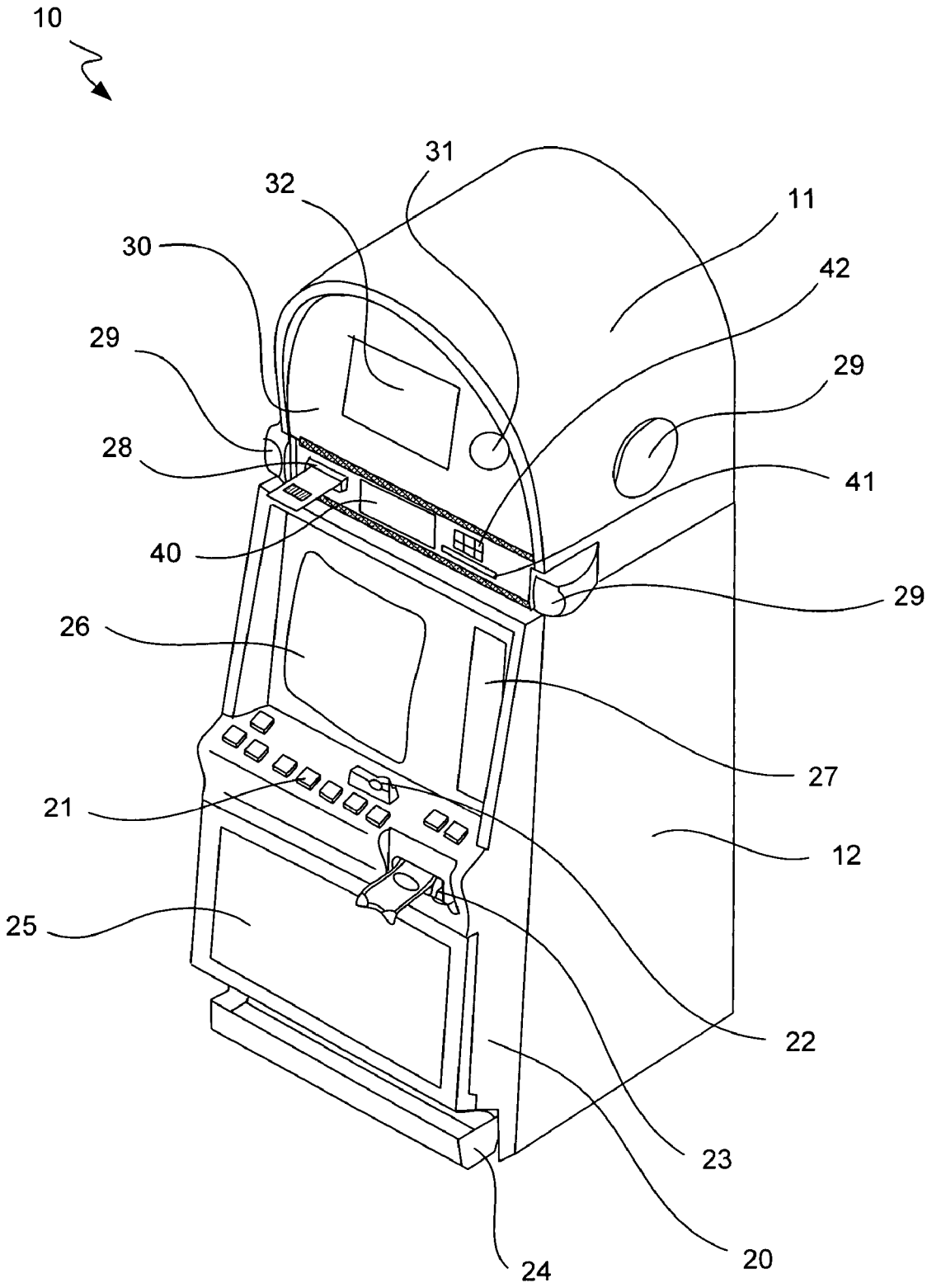
FIG. 1 illustrates in perspective view an exemplary gaming machine that can be adapted to facilitate the provision of ticket drawing games having escalating discrete prize levels according to one embodiment of the present invention.

Referring first to FIG. 1, an exemplary gaming machine that can be adapted to facilitate the provision of ticket drawing games having escalating discrete prize levels according to one embodiment of the present invention is illustrated in perspective view. While gaming machine 10 is one exemplary item of the many different machines and devices that can be used as a part of an automated ticket drawing program or system, it will be understood that many of the inventive ticket drawings, ticket drawing bonus games, methods and systems disclosed herein are preferably used in conjunction with this and/or one or more similarly suitable gaming machines or devices. Further devices, system and network items that can be used as part of an overall gaming system adapted to provide such ticket drawings and ticket drawing bonus games are described in greater detail below with respect to FIG. 2.

As shown, gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, one or more money or credit acceptors, such as a coin acceptor 22 and a bill or ticket validator 23, a coin tray 24, and a belly glass 25. Viewable through main door 20 is a primary video display monitor 26 and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket printer 28, one or more speakers 29, a top glass 30, one or more cameras 31, and a secondary video display monitor 32, which can similarly be a cathode ray tube, a high resolution flat-panel LCD, a plasma/LED display or any other conventional or other type of appropriate video monitor. Alternatively, secondary display monitor 32 might also be foregone in place of other displays, such as gaming reels or physical dioramas that might include other moving components, such as, for example, one or more movable dice, a spinning wheel or a rotating display, among others.

In addition, gaming machine 10 may contain a player tracking unit in some form, such as a self contained player tracking box attached to the top or side of the gaming machine, as is known in the art. As shown, various components of a player tracking unit have been incorporated into and within the base of top box 11, such that a more aesthetically pleasing appearance results. In particular, a player tracking video display 40, a slot for a player tracking card 41 and a player tracking keypad 42 are provided. Additional features and applications for a video capable player tracking device can also be found in, for example, commonly owned U.S. patent application Ser. No. 10/246,373 by Hedrick, et al., entitled "Player Tracking Communication Mechanisms in a Gaming Machine," which is incorporated herein by reference in its entirety and for all purposes. It will be understood that many makes, models, types and varieties of gaming machines exist, that not every such gaming machine will include each of the foregoing items, and that many gaming machines will include other items not shown. Such gaming machines are made by many manufacturers, such as, for example, IGT.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A more detailed description of many such specializations in electronic gaming machines relative to general-purpose computing machines and specific examples of the additional or different components and features found in such electronic gaming machines can be found in, for example, commonly owned U.S. patent application Ser. No. 11/077,241 by Crivelli, entitled "Printer Interpreter For A Gaming Machine," which is incorporated herein by reference in its entirety and for all purposes.

With respect to the basic gaming abilities provided, it will be readily understood that gaming machine 10 can be adapted for presenting and playing any of a number of games and gaming events, particularly games of chance involving a player wager and potential monetary or other payout, such as, for example, a wager on a sporting event or general play as a slot machine game, a keno game, a video poker game, a video blackjack game, a video table game and/or any other Class II or Class III game, among others. While gaming machine 10 can typically be adapted for live game play with a physically present player, it is also contemplated that such a gaming machine may also be adapted for game play with a player at a remote gaming terminal. Other features, functions and devices may also be used in association with gaming machine 10, and it is contemplated that the present invention can be used in conjunction with a gaming machine or device that might encompass any or all such additional types of features, functions and devices. Of course, one type of item that is specifically contemplated for use with the present invention in association with a gaming machine such as gaming machine 10 involves ticket based drawings and drawing bonus games, as described in greater detail below.

Figure 2:
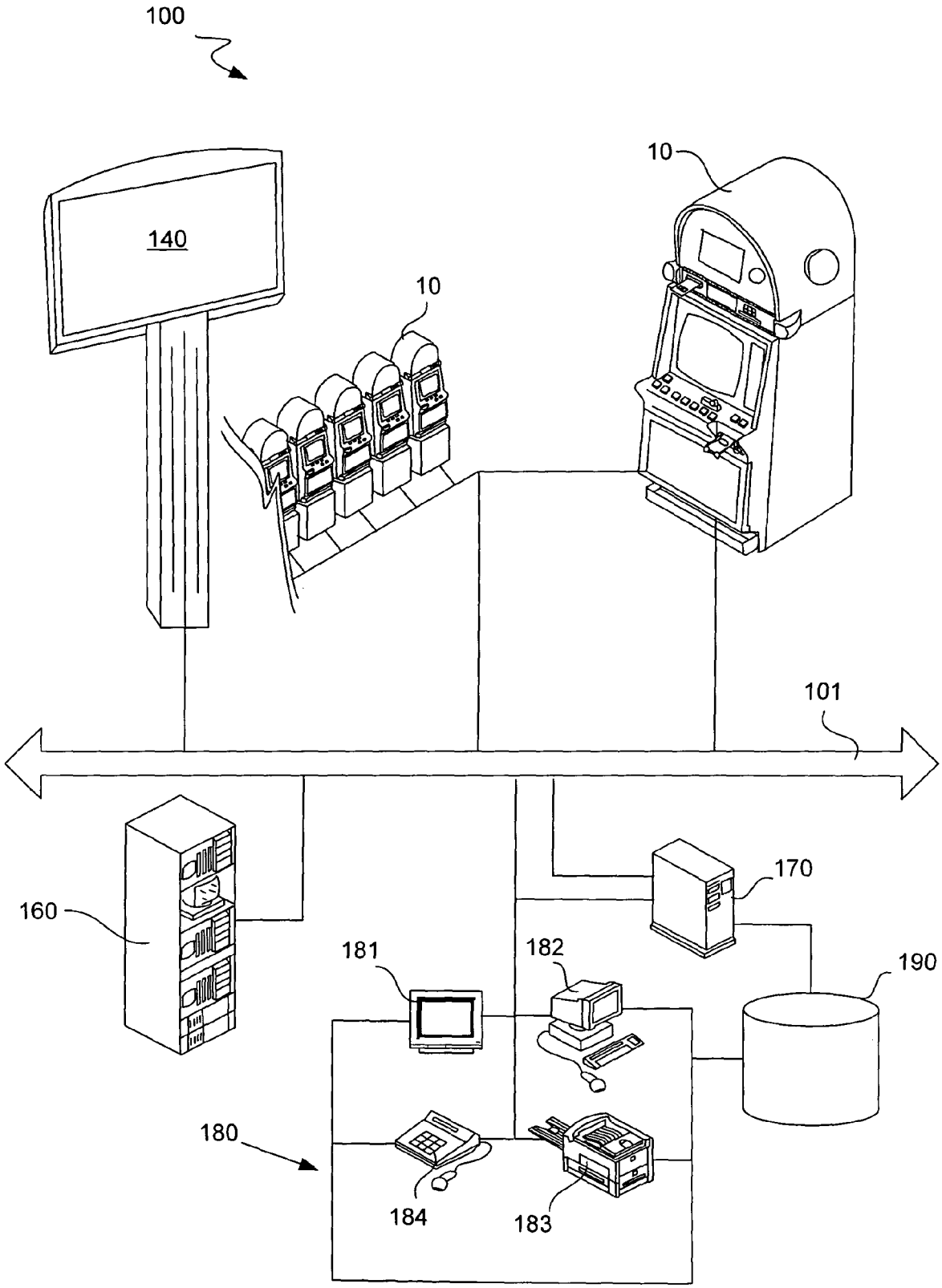
FIG. 2 illustrates in block diagram format an exemplary network infrastructure for providing an overall gaming system adapted to provide ticket drawings and ticket drawing bonus games having escalating discrete prize levels according to one embodiment of the present invention.

Turning next to FIG. 2, an exemplary network infrastructure for providing an overall gaming system adapted to provide ticket drawings and ticket drawing bonus games having escalating discrete prize levels is illustrated in block diagram format. Exemplary gaming system 100 has one or more gaming machines, various communication items, and a number of host-side components and devices adapted for use within a gaming environment. As shown, one or more gaming machines 10, gaming terminals or other pertinent devices adapted for use in gaming system 100 can be in a plurality of locations, such as in banks on a casino floor, in groups at a bar or other table based location (not shown), and/or standing alone at a smaller primarily non-gaming establishment, such as a convenience store or restaurant, as desired.

As will be readily appreciated, each such gaming machine 10 or other pertinent device adapted to present ticket drawings can be associated with at least one player tracking unit and an overall player tracking system. As noted above, such an association can result in the provision of at least one player tracking video screen at each such gaming machine or pertinent device, with such a video screen being usable to present some or all of the various portions of the subject ticket drawings. Of course, one or more gaming machines 10 that may be eligible for participation in the various provided ticket drawings may be able to take part without providing its own individual video display, such as where entry qualifications can be detected and appropriate communications can be made with the rest of the system for appropriate processing of a new entry and any necessary display of information.

In addition, one or more separate stand alone video screens 140 can also be provided to present any or all of the various portions of subject ticket drawings, ticket drawing bonus games and the like. Such added video screens 140 can be in the form of, for example, a separate screen above a bank or group of gaming machines, as well as at any of a number of prominent locations within the sponsoring gaming establishment. Where one or more gaming machines are not capable of providing their own video displays to present ticket drawing events and information, such added video screens can serve as an appropriate presentation display. Further, such an added video screen or screens can be duplicative of and/or auxiliary to the various individual video screens that may actually be provided at any of the individual gaming machines or terminals. As in the case of any of the foregoing displays, such video screens 140 can be, for example, CRTs, LEDs, projections screens, plasma displays, or any other suitable screen for displaying various ticket drawing aspects.

With respect to other system elements, common bus 101 can connect one or more gaming machines 10, terminals, devices and/or additional displays 140 to a number of networked devices on the gaming system 100, such as, for example, a general-purpose server 160, one or more special-purpose servers 170, a sub-network of peripheral devices 180, and/or a database 190. A general-purpose server 160 may be one that is already present within a casino, bar, convenience store or other relevant gaming establishment for one or more other purposes beyond any player tracking and/or ticket drawing functions with respect to a gaming environment. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to player tracking operations, player account administration, remote game play administration, remote game player verification, downloadable gaming, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 100 contains one or more special-purpose servers 170 that can be used for various functions relating to the provision of player tracking and rewards programs, as well as automated ticket drawings and ticket drawing bonus games according to the various inventive systems and methods disclosed herein. In addition, such a special-purpose server or servers could include, for example, a cashless gaming server, a player verification server, a general game server, a downloadable games server, a specialized accounting server, and/or a visual image or video distribution server, among others. Of course, these functions may all be combined onto a single server, such as specialized server 170, or they may be separate out to different servers and/or systems altogether. Such additional special-purpose servers are desirable for a variety of reasons, such as, for example, to lessen the burden on an existing general-purpose server or to isolate or wall off some or all player tracking, rewards, ticket drawing, and other specialized data and functions from the general-purpose server, and thereby increase security and limit the possible modes of access to such operations and information.

Alternatively, exemplary gaming system 100 can be isolated from any other network at the establishment, such that a general-purpose server is essentially impractical and unnecessary. Under either embodiment of an isolated or shared network, one or more of the special-purpose servers are preferably connected to sub-network 180, which might be, for example, a cashier station or terminal, or a control room or office. Peripheral devices in this sub-network may include, for example, one or more video displays 181, one or more user terminals 182, one or more printers 183, and one or more other input devices 184, such as a keyboard, keypad, mouse, card reader or other security identifier, among others. Under any network embodiment, specialized server 170 or another similar component within a general-purpose server 160 preferably includes a connection to at least one database or other suitable storage medium 190. Database 190 can be adapted to store many or all files having pertinent data or information regarding, for example, player tracking data and totals, ticket drawing histories and parameters, and current ticket drawing information, among other potential items. Files, data and other information on database 190 can be stored for backup purposes, and are preferably accessible at one or more system locations, such as at a general-purpose server 160, a special purpose server 170 and/or a cashier station or other sub-network office or control location 180, as desired.

While gaming system 100 can be a system that is specially designed and created new for use in a casino, bar, store, or other suitable gaming establishment, it is also possible that many items in this system can be taken or adopted from an existing gaming system. That is, gaming system 100 could represent an existing gaming system or network to which one or more of the inventive components or program modules are added, such as, for example, an existing player tracking and rewards system. In addition to new hardware, such as any necessary new video displays and/or ticket receipt printers, if desired, new functionality via new software, modules, updates or otherwise can be provided to an already existing database 190, specialized server 170 and/or general-purpose server 160, as desired. In this manner, the methods and systems of the present invention may be practiced at reduced costs by gaming operators that already have existing gaming systems, such as, for example, an existing player tracking system, by simply modifying the existing gaming system. Other modifications to an existing system may also be needed, as can be appreciated.

Ticket Based Drawings and Bonus Games

As noted above, any or all of the foregoing gaming machines, tracking units, devices and systems can be used in conjunction with and to provide one or more ticket based drawings and ticket drawing bonus games, and in particular ticket drawings and games that are automated. In some embodiments, a particular brand name and/or title can be provided with respect to such automated ticket drawings, with a particular example being an "EZ Drawings" brand or title. To note, a "ticket drawing bonus game" refers to a ticket drawing that awards some or all of its ticket entries to players as a result of a primary wager based game, while the more general "ticket drawing" can refer to any ticket drawing regardless of how tickets are actually awarded, such that a ticket drawing bonus game is necessarily a ticket drawing in its broad sense. Although such a distinction can be made, it will be understood that these terms, as well as the terms "game" and "drawing" can be used interchangeably for one other throughout the provided detailed description herein, as warranted.

In one embodiment, the various provided ticket drawings and games can be made available only in "restricted" environments, such as at bars, convenience stores, sole proprietorships and other locations having a limited number of gaming machines, terminal or other suitable gaming devices. In some embodiments, such ticket drawings may similarly be made available to unrestricted environments, including major casinos and other gaming establishments having large numbers of gaming machines and other suitable gaming devices. In some embodiments, one or more ticket drawings or games may be isolated to a single restricted environment or gaming establishment, or even to a specific subset of gaming machines within such an establishment, or even to a single gaming machine or terminal. In still further embodiments, one or more ticket drawings or games may be conducted on a large number of gaming machines and devices as part of a wide area network across multiple gaming properties, or even statewide or nationwide, as may be permissible.

Both the general ticket drawings and more specific ticket drawing bonus games preferably comprise several key elements. First, each ticket drawing can be structured such that a number of different prizes may potentially be awarded, with the actual prize that is awarded depending upon the number of actual ticket entries that are input at the time of the ticket drawing itself. In this manner, a number of discrete and escalating prize levels can be created, with graduation from one prize level to the next occurring once a set number of ticket entries are created and/or received into the ticket drawing.

Further, each ticket drawing can have a defined ticket entry award period and a defined ticket drawing time or event, any or all of which can be scheduled or can depend upon a predefined triggering event. In addition, a series of continuous or even perpetual drawings can be established, whereby the end of one drawing results in the start of another drawing. As yet another key element, multiple drawings may be provided at the same time (e.g., an hourly and a daily drawing), at least to the extent that the ticket entry acceptance periods of two simultaneously running drawings at least partially overlap. Such an arrangement can be structured such that there is always at least one drawing in a series of coordinated or associated multiple ticket drawings that has a current prize that is greater than the minimum or base prize for that drawing.

As a specific illustrative example, a given specific ticket drawing may be structured to run for a given period, such as an hour. An escalating prize structure may be implemented such that a "free coffee" or $5 is the base prize that would be won if the ticket drawing is held with only 1 to 4 ticket entries in the "bin" or ticket hopper. Once the 5th ticket entry is created and submitted, however, then the current prize graduates or is "reset" to the next prize level, which prize may be a "free breakfast" or $10. Such a prize can be predefined to graduate or be reset again once 10 ticket entries are received, with such a further improved prize being a "free lunch" or $20 for example. The next prize level may be set for 20 ticket entries, at which point a "free dinner" or $40 can be the upgraded prize, with a further upgraded prize being a "free dinner for two" or $80 in the event that 40 ticket entries are received for the drawing. Further graduation of prizes for specific numbers of ticket entries may also be provided, as desired. In this manner, better prizes can be provided for more ticket entries that may be put into a given ticket drawing, such that the prize that is actually awarded is at least relatively commensurate with the level of player participation for a given drawing. Such prize certainty with respect to the level of play is a feature that will typically appeal to many drawing providers.

As another illustrative example, a more long term ticket drawing can be provided, such as a yearly ticket drawing. For such a long term drawing, a base prize might involve a weekend stay at a nice hotel or resort, with the next level prize being round trip airfare to anywhere in the country, the next level prize being a one week vacation, the next prize being a two week vacation, and so forth, with an ultimate prize being a free car. In this manner, an ultimate high level prize can be offered and made available, but only if the overall number of ticket entries reaches an amount that the ticket drawing provider has determined to be worthwhile in order to award such an expensive prize. Such a mechanism provides a safeguard to gaming operators and other ticket drawing providers in the event that an expected level of participation is not reached, but still permits an appropriately valuable prize to be available to those players who did participate and were awarded one or more ticket entries.

As noted, drawings can be based upon a variety of different time periods, such as hourly, daily, weekly, monthly, yearly and the like. Of course, other periods such as bi-weekly, semiannually and others may also be used, as desired by a given drawing provider. As also noted, multiple drawings may be structured to run simultaneously, such as in the instance of a "Long" and "Short" drawing. In such a two drawing coordinated system, the Long drawing may represent a daily drawing, while the Short drawing may represent an hourly drawing. Continuous or perpetual drawings may be established for each of a series of Long and Short drawings, such that there is always one Long drawing running and always one Short drawing running. Although each Short drawing can be set to begin and end on the hour, and each Long drawing can be set to begin and end at midnight, it may be preferable to designate other more player appealing times. In particular, it may be preferable for the actual ticket drawing for the Long drawing to occur at a time that is separate from any of the 24 actual hourly ticket drawings that can be structured take place in a given day. For example, many or all daily ticket drawings can take place at 7:30 PM every day, while each hourly drawing takes place at the top of the hour.

Further ticket drawings in addition to the given series of Long and Short drawings may also be provided, such as, for example, a "Long Term" monthly drawing and/or a "Legacy" yearly drawing, as will be readily appreciated. In such instances, three, four or more drawings can be structured to run simultaneously with respect to one another. In many regards, such simultaneous drawings may have one or more items in common. One such item could be the manner in which certain kinds of ticket entries are awarded. For example, one or more simultaneous drawings, such as a Long and Short drawing, can both be set to award a ticket entry to any video poker player who hits a 4-of-a-kind. In this manner, the same primary wager based game result or other triggering event can result in multiple entries across multiple different ticket drawing games. Thus, a given player may be entered into multiple ticket drawings as a result of a single game outcome, such as a full house.

While the predefined start and end times for a given ticket drawing can be scheduled for a set date and time, a predefined triggering event might alternatively be used. Such a triggering event could be a particular game outcome hit at any given gaming machine or terminal participating in the ticket drawing. Such primary game outcomes could include, for example, a royal flush, straight flush, 3 or more bars, 1000 coin payout, 10,000 coin payout and linked progressive jackpot, among others. In some embodiments, such a hit could result in the ticket acceptance period being closed immediately, with a winning ticket being drawn immediately thereafter. In the event that the given drawing is a part of a series of continuous or perpetual drawings, the same hit or event could then also trigger the start of the subsequent ticket drawing.

Although ticket entries could be awarded for any of a virtually limitless number of reasons or events and to any player, patron or potential player or patron, it is contemplated that certain events and persons may be more preferable than others. For example, it may be preferable to require any person to whom a ticket entry may be awarded to belong to an appropriate player tracking or rewards program. In some embodiments, ticket entries are only awarded to those players who are members of a player rewards program and who have provided appropriate identification indicia prior to playing regular or primary wager based games, such as at an associated gaming machine or table game. Such identification indicia can include any form of player tracking ID, such as a typical magnetic stripe player tracking card. In one embodiment, eligibility to receive ticket entries is dependent upon an active player making collective wagers at or above a minimum threshold, such as, for example, one dollar at a gaming machine, or ten dollars at a table game. In the case of a gaming machine, such a threshold could be reached by playing multiple paylines and/or multiple coins or credits per payline, such that the collective wager qualifies. In addition, a given drawing provider may require a winning player to be present at the time that his or her winning ticket is drawn in order to win the prize. Alternatively, one or more of the foregoing requirements may not be necessary, as desired by a given gaming operator and/or ticket drawing provider.

In various embodiments, ticket entries can be awarded for a variety of primary wager based game outcomes. For example, outcomes that may be selected to result in a ticket entry being awarded can include the video poker outcomes of 3-of-a-kind, straight, flush, full house, 4-of-a-kind, straight flush and royal flush, among others. Specific hands might also result in a ticket entry, such as, for example, any hand including at least three 2s. Various slots outcomes that might result in a ticket entry being awarded can include, for example, two matching reel symbols, three matching reel symbols, a specialized reel symbol, or any particular combination of reel symbols or arrangements, as desired. With respect to both video poker and slots, other outcomes that could result in a ticket entry being awarded can include a 10 coin payout, a 20 coin payout, a 50 coin payout and a 100 coin payout, among others. Such coin or credit payouts can be exact, or may be set to result in a ticket award for any payout that matches or exceeds the set payout amount. Table game outcomes that might result in a ticket entry being awarded can include, for example, a blackjack or specific form of blackjack, and/or a 6-7-8 or 7-7-7 blackjack hand, among others.

In addition to or in place of such primary wager based game outcomes, various other promotional events can be defined as ticket award triggers. Various examples of such other ticket generating events can include a specific number of coins input to and wagered at a gaming machine or collection of gaming machines, a certain level of money spent at a dinner or merchandise purchase at a sponsoring venue, or simply walking in the door of the gaming establishment or venue at a particularly appropriate time, among other items. Additional events and reasons for awarding ticket entries can be included, and it is specifically contemplated that the illustrative examples provided herein do not limit such other events and reasons, and are but a small sample of the various possibilities that may be available.

Because the ticket drawings and ticket drawing bonus games provided herein are preferably automated, such as through the various gaming machines, servers, databases and other system components disclosed above, such drawings can be fully auditable. That is, the history of many or all facets of a given drawing can be traced through electronic records, including records for each ticket entry awarded, for the start and end times, and for the actual ticket drawing itself. In this manner, the possibilities for error and fraud that are associated with many forms of paper and manual ticket drawings can be minimized or eliminated. Questions as to the integrity of any ticket entry, group of ticket entries, or ticket drawing or pull can be checked against the stored history of a game.

In various specific embodiments, all ticket entries could be stored in a particular database, and could then be validated against a separate Location Cache Controller ("LCC") database, such as that which might be associated with a particular player rewards program event table, such as, for example, a Rampant Rewards event table. An interface entry mechanism can be adapted to receive various entry socket messages from the Rampant Rewards LCC Process or other similar player tracking process on, for example, "Port 6000" of a standard commercially available IP socket based interface system or process. Pertinent communicated items can include, for example, a "TransactionID" from the LCC database, which is auditable and gives the record of the transaction in the respective player tracking system, a "PlayerID" or card number for the player tracking account, a "MachineID" or identification number of the gaming machine on which the ticket awarding event occurred, an "EventID," which can be one of any number of defined event numbers or identifiers from the player tracking program, an "EventDateTime" denoting the date and time the communication was sent, and a "CurrentDateTime" date time when the transaction is sent to the game processor.

When a given transaction is received from the LCC processor, it is then processed by the game processor to see if it qualifies for an active drawing. As such, the event can compared to the drawing settings for one or more qualifying items or terms, as may be appropriate. Such items or terms can include, for example, an "Entry Date and Time," whereby the triggering event must occur within the active drawing time or it will roll into the next drawing. Also, an "Event ID Qualifier" might be checked to ensure that the Event ID (e.g., four-of-a-kind) is compared against the appropriate event qualifier list for the active drawing. If the entry meets the various entry qualifications for the drawing, the entry is then placed into a MasterEntryTable database table, and the ticket entry counter is incremented by one. The video display may then shows the entry with all of its information being added to the virtual drawing "bin." If for some reason the entry does not meet the qualification requirements, it may be ignored. When the actual ticket drawing occurs, the game controller scans the LCC database event table for new entries that may have been missed, and any new entries are added before the actual drawing occurs.

While automation may be relatively simple with respect to a network of electronic gaming machines, as will be readily appreciated, further devices may be required at locations that are not so handily automated. For example, primary games at a gaming table are typically conducted in a fully or mostly manual fashion, such that automation in conjunction with an automated ticket drawing may require extra effort and/or further gaming devices at the gaming table. At a minimum, it would be preferable to provide an interface at one or more gaming tables, such that a dealer or other gaming personnel would be able to manually process a ticket entry into the otherwise automated system whenever such a ticket entry is to be awarded. Such a device or devices may include a card reader, keypad, display and/or touch screen, among other items. Where more sophisticated table games provide for some form of advanced automation, such as, for example, card and seat recognition features, more automation with respect to a ticket drawing automate system may be available. In the event that ticket entries are awarded for other events beyond gaming machines and/or gaming tables, such manual devices may be provided at other locations, such as at concierge desks, cashiers and restaurant waitstaff facilities.

Although the provided ticket drawings are preferably fully automated through an electronic system or gaming network, it may nevertheless be desirable to provide paper tickets or receipts as well. Such tangible items can serve as proof, and may also provide backup in the event of a power failure or electronic system crash. In some embodiments, a paper ticket can be printed to a central operator controlled location every time that a ticket entry is generated. These backup paper tickets can then be used to conduct a manual ticket drawing in case of a failure or malfunction in the automated ticket drawing system before or during the actual automated ticket drawing. In addition, a paper receipt can be printed and provided to the player at the time that the ticket entry is awarded. Such a receipt may constitute proof that a player was awarded a particular ticket entry, and/or could at least provide a handy tangible reference to the player that he or she has a ticket entry for a particular drawing.

In various embodiments, additional prizes beyond a main prize may be provided for one or more ticket drawings or games. For example, while each ticket drawing preferably has at least a main prize, a secondary prize of equal or lesser value might be provided as well. Such a secondary or further prize might be awarded to a second or subsequent drawn ticket. Alternatively, such additional prizes may be awarded based on other criteria, such as the player having the most ticket entries in a given ticket drawing. In one embodiment, such a second or further prize may simply involve granting additional ticket entries for currently running or subsequent ticket drawings to the winning player.

As noted above, one particular advantage that can be applied to the disclosed automated ticket drawings and games can be that of a more vivid and entertaining presentation, such as through one or more video screens. As such, various embodiments of the present invention include one or more graphical presentations or screens. Specific graphical presentations can be provided for a number of different items, such as, for example, a creation of a new ticket entry, the actual ticket prize drawing, a main screen showing various informational items associated with a particular drawing, and an advertisement, among others. Such advertisements in particular can be configured to be displayed during "quiet time," such as after the respective gaming machine and/or ticket drawing game have experienced no activity over a set period of time.

In addition, a scrolling ticker can be provided at the edge of any given screen, such that pertinent game information and data can be presented even while other screens, animations and/or advertisements are being shown. Such a scrolling ticker can be at the bottom of the screen, although the top or either side might work equally well. Information to be contained within such a scrolling ticket might include some or all of the items that are typically displayed on a main screen, as set forth in greater detail below. Although the scrolling ticker can be primarily text based, various combinations of colors, fonts, sizes and overall "skins" can be created for such a ticket, to be applied as may be warranted by the particular animation or advertising screen upon which the scrolling ticker may be running.

With respect to a ticket entry being awarded, when the qualifying event occurs, an associated video display can show an animated sequence illustrating the ticket entry being made to one or more virtual drawing bins, depending upon the ticket entry awarding event. The ticket entry can show a number of informational items, such as the player name and account number, as well as the machine or gaming table at which the ticket entry was awarded. Other informational items that can be shown either on the ticket entry or the animated ticket awarding screen in general can include, for example, a bar coded player number the date and time of the drawing, the triggering event that may result in the drawing, if applicable, the current prize and the number of entries needed to reset or advance this prize to a better prize, and, among other items. The bar coded player number might then be scanned at a player rewards terminal or kiosk for further player rewards related activity.

The video display can also show a main screen having a variety of information items relating to a previous, current or future drawing, including a countdown to the next drawing time, if applicable, as well as the number of additional entries required to get to the next prize level. When the countdown ends, an animated drawing might then start for the prize defined by the current prize level. Such an event may result in the main display screen cutting away to a ticket prize drawing animation screen. The selected winning entry can then be displayed on the drawing screen and a receipt can be printed with the winning entry information, such as player account name and number, machine number and prize won.

In one embodiment, the various display graphics can be stored in media files that are separate from the game core logic. This can allows for a variety of interchangeable themed looks or "skins," such that various game presentations and animations can be created, sold and stored separately. Such themes can include, for example, a "High Tech" theme or a "Saloon Keeper" theme, among others. Themes that may be appropriate for particular days, seasons or locations might be created as well, such as a "Green" or "Leprechaun" theme for St. Patrick's Day ticket drawings, or a "Fireworks" theme for Fourth of July ticket drawings.

In an exemplary "High Tech" theme, a main display could involve an environment that uses a robotic chrome drum. As noted above, the main display can alternate or toggle between Long and Short drawings, with respective information for each being shown in alternating fashion. In particular, a countdown timer and the current prize can be shown, along with how many more entries are required for the next prize level. When new ticket entries are created, a ticket entry animation screen can depict new entry information that would be graphically bar coded and engraved onto a sphere that is then placed in an animated electronic drawing bin, as depicted in the various screen shots below. When the actual ticket prize drawing occurs, another animation sequence could be provided on a ticket prize drawing animation screen, where the robotic arm would pick an entry, scan the barcode and display the winner.

In an exemplary "Cowboy Barkeep" theme, a cowboy barkeeper can be depicted in old western bar environment with, such a bartender potentially being reminiscent of any of a number of famous cowboys, movie stars or the like. When a new entry occurs, a ticket entry animation screen can depict the bartender writing the player ID on a beer bottle and placing the bottle on a shelf. When the drawing occurs a ticket prize drawing animation screen animation screen might show the bartender blindfolding himself and shooting one of the bottles over this shoulder. The bartender could then pick up the label of the shot bottle and show the outcome of the drawing. Of course, any number of other themes and possibilities could be developed in order to further facilitate the entertainment and video aspect values of the inventive ticket drawings and drawing bonus games, as will be readily appreciated.

Figure 3A:
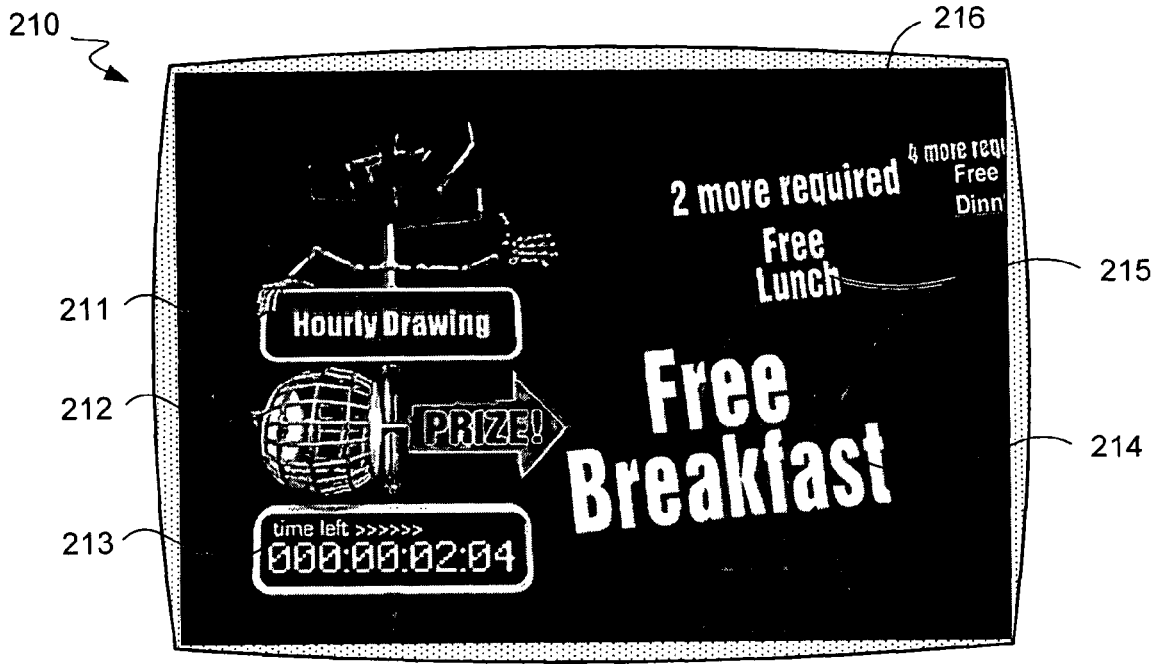
FIG. 3A illustrates in screen shot format an exemplary ticket drawing video display, and in particular a main display for an hourly ticket drawing according to one embodiment of the present invention.
Figure 3B:
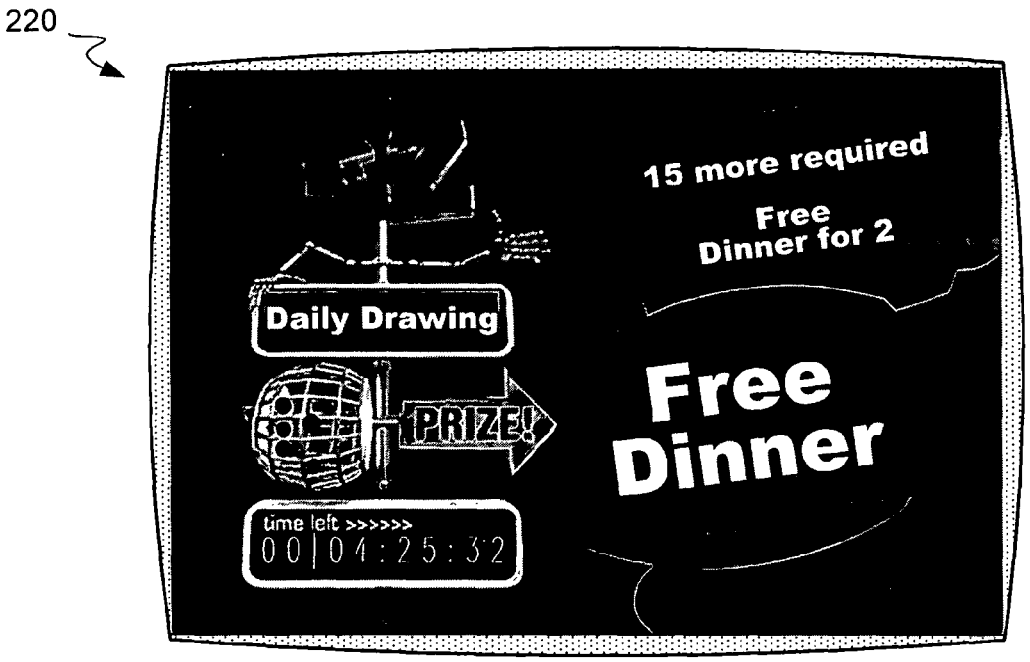
FIG. 3B illustrates in screen shot format another exemplary ticket drawing video display, and in particular a main display for a daily ticket drawing according to one embodiment of the present invention.

FIGS. 3A, 3B and 4-6 illustrate in screen shot format various exemplary ticket drawing graphical or video displays according to various embodiments of the present invention. In particular, a science fiction or "High Tech" theme is provided for the various screen shots depicted in these figures. Referring first to FIG. 3A, a main display for an hourly ticket drawing is shown. Screen 210 comprises a main display having a friendly robotic arm and a variety of informational items, such as the type of drawing 211, the drawing bin 212 and a countdown timer to the actual ticket prize drawing 213. In this particular example, the drawing bin 212 is presently empty, and there are only 2 minutes and 4 seconds left until the prize drawing. Other informational items can include the specific current prize 214, the specific prize at the next prize level 215, and the number of additional entries required to advance the prize to the next prize level 216, among others. Referring next to FIG. 3B, a main display for a daily ticket drawing is shown. Main display screen 220 can be substantially similar to screen 210, particularly where the theme is the same for the daily drawing as it is for the hourly drawing. Items may differ to some degree, particularly the various informational items, as will be readily appreciated. In the particular example illustrated for a daily drawing, several balls or "ticket entries" are already present in the bin, there are still over 4 hours and 25 minutes until the actual drawing, the current actual prize is a free dinner, and so forth.

Figure 4:
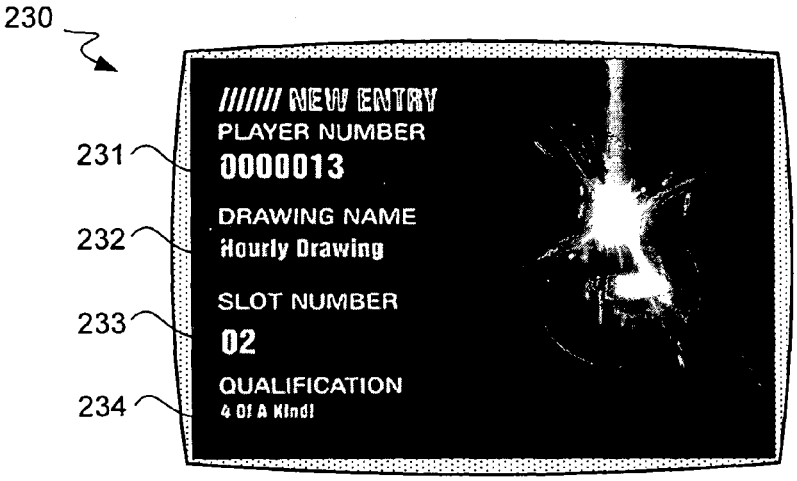
FIG. 4 illustrates in screen shot format yet another exemplary ticket drawing video display, and in particular a frame of a ticket entry creation animation screen according to one embodiment of the present invention.

Continuing on to FIG. 4, a frame of a ticket entry creation animation screen is shown. Screen 230 depicts a high tech entry ball or "ticket" being created for placement in the drawing bin. An animation can be made to show a laser carving out the pertinent information for the particular entry, with such information also being provided alongside the entry as it is being created. Such information can include, for example, a player name, number or other ID 231, the drawing name and/or specific time and date of the drawing 232, the gaming machine ID and/or location awarding the ticket entry 233, and the qualifying event 234 resulting in the ticket entry being awarded, among other items.

Figure 5:
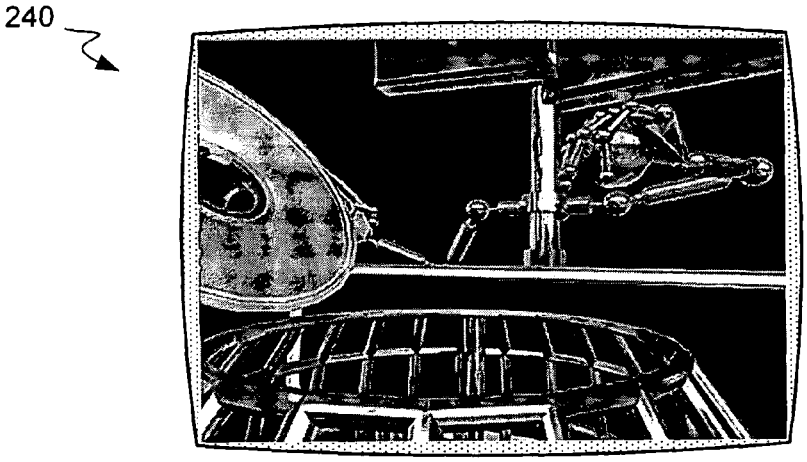
FIG. 5 illustrates in screen shot format still another exemplary ticket drawing video display, and in particular a frame of a ticket prize drawing animation screen according to one embodiment of the present invention.
Figure 6:
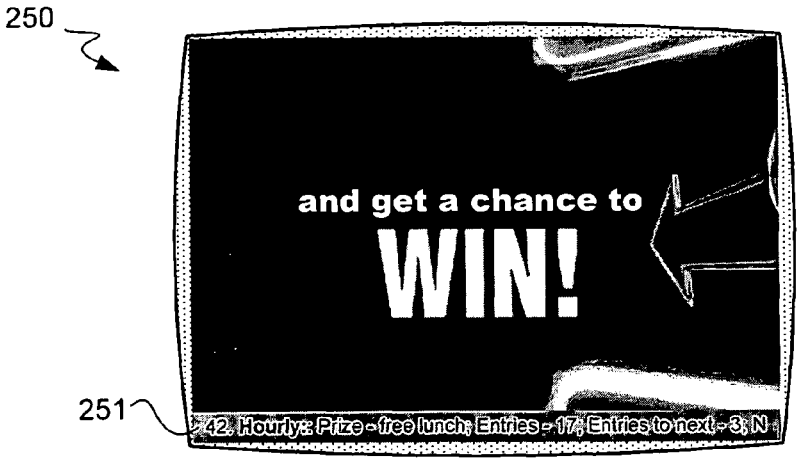
FIG. 6 illustrates in screen shot format one more exemplary ticket drawing video display, and in particular an advertisement screen having a scrolling ticker at the bottom edge according to one embodiment of the present invention.

Next, FIG. 5 illustrates a frame of a ticket prize drawing animation screen. Screen 240 shows a scene from the actual ticket prize drawing itself, where the friendly robotic arm can be made to open the ticket bin and pull out a winning ball or ticket. As shown, the arm has just selected the winning ball (i.e., ticket), and is about to display it to reveal the winner of the drawing. Finally, FIG. 6 depicts an advertisement screen having a scrolling ticker. As shown, screen 250 is displaying a promotional advertisement for the drawing ticket bonus games themselves, such as where information regarding the ways that ticket entries can be awarded is provided. Although the main portion of the screen can be wholly directed toward advertising of any form, at least some ticket drawing information can be provided during the running of such advertisements, such as at the scrolling ticker 251 at the bottom edge of the screen. As can be seen, scrolling ticker is currently displaying information regarding the present hourly drawing, such as the current prize, the number of current entries, and the number of entries to the next prize level. As the ticker scrolls, the "Next Prize" will then be shown, after which further information can be provided, including information on the current daily drawing as well.

With respect to various detailed embodiments, the provision of multiple video displays across the entire system can result in different displays being shown simultaneously at different display devices. In this regard, the central game server or processor can be adapted to forward different display screens to different display devices across a distributed network of display devices. Such video display devices may be generally "dumb" in nature, in that each device can only present the screens, images or animations that are immediately provided to it. In more advanced systems, such video displays and/or any associated player tracking devices might be provided with a sufficiently level of processing power so as to permit players to select or toggle the display screens to be shown, as may be desired.

For example, one player may wish to monitor the information regarding the hourly drawing, while another player may care more about the daily drawing. In such an instance, the appropriate main display screen for each respective drawing may be presented to each player at the same time, such that both players are satisfied. In some instances, a "zone" or general display may be provided, such as for a community display, bank display, or as a default display for any given player tracking device. In addition, further "personal" or specific displays may be provided to those players where such different display screens would be more appropriate, such as due to specific local triggering events or player preferences.

In some embodiments, various game settings can be configured or edited via one or more provided operator interfaces. Although a graphical user interface of any sort, such as a simple form-based graphical user interface, is preferable, such operator interfaces may also be input by designated manual commands in the event that such a graphical user interface is not provided. For example, an operator may be able to control a given game with the keyboard while the drawing period is active. Simple keyboard controls might include, for example, F4 for Exit; F6 for Admin Mode; F8 for a Reprint of the Last "Short" Drawing Details (including winning details); F9 for a Reprint the Last "Long" Drawing Details (including winning details); F10 for a Print of the Current "Short" Drawing Details; and F11 for a Print of the Current "Long" Drawing Details, among others. Additional commands and controls may be provided, although a graphical user interface may be preferable.

Referring to FIGS. 7A-7F, various representations of an exemplary graphical user interface used as part of an operator set of controls for configuring one or more automated ticket drawings according to one embodiment of the present invention are illustrated in screen shot format. Such a graphical user interface can be provided through a central server interface to a gaming machine or terminal itself, or to a central office or control room, such as a location having control peripherals 180 shown in FIG. 2. Although specific examples and options for an exemplary graphical user interface are provided, it will be readily appreciated that a virtually limitless number of options and items may be provided in such an interface.

Figure 7A:
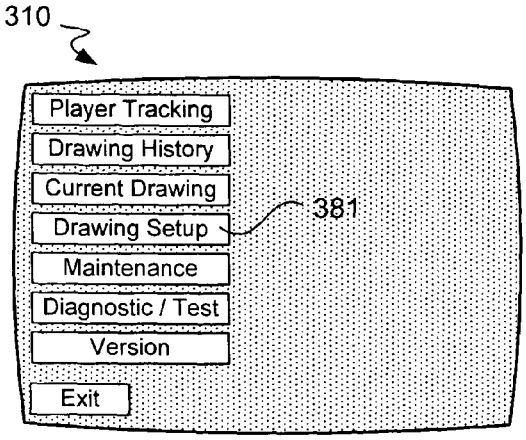
FIGS. 7A-7F illustrate in screen shot format various representations of an exemplary graphical user interface used as part of an operator set of controls for configuring one or more automated ticket drawings according to one embodiment of the present invention.
Figure 7B:
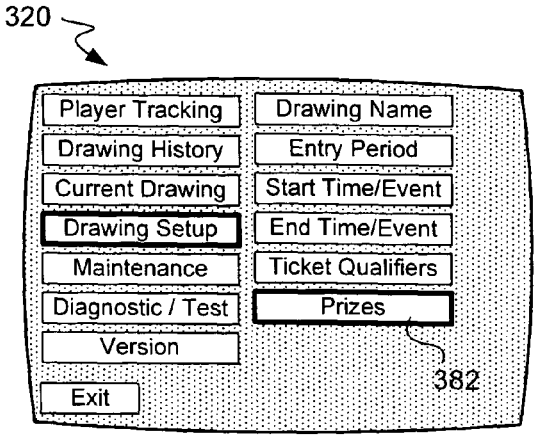

From FIG. 7A, screen 310 depicts an initial menu having a variety of touch screen buttons or other input selection options 381, one or more of which can involve a "Drawing Setup" option for configuring one or more ticket drawing game parameters. Of course, a variety of additional options may also be provided, as are illustrated. As shown in screen 320 of FIG. 7B, a submenu with further options or inputs 382 can be made to appear once this "Setup" option has been selected, with one such further option being that for "Prizes." Upon selection of such a setting box or input, a further input box or item might be provided, such as that which is shown in screen 330 of FIG. 7C. In this limited example, a series of default or previously used prizes can appear in a plurality of actual prize boxes 383.

Figure 7C:
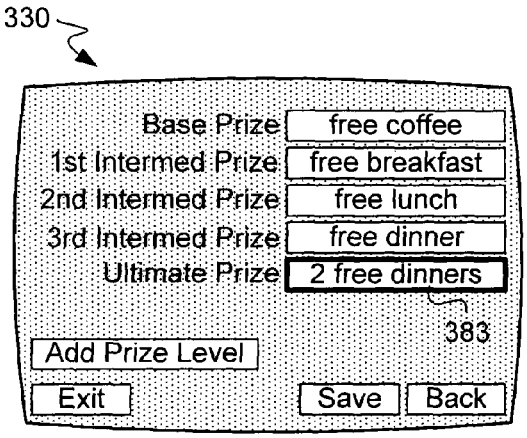

Such default or previously used settings can also include the number of actual discrete prize levels, such as the five discrete prize levels shown in FIG. 7C. Of course, one or more options may be provided to add and/or delete prize levels, as may be desired. Where the number of prize levels becomes too great to fit within one screen, a scrolling, toggle or other suitable screen management feature can be used to show a subset of all available prize levels, as will be readily appreciated. Although not shown, provisions for determining continuous discrete prize levels, such as by a formula, may also be provided. In addition, various graphical user interface buttons may also be provided, such as, for example, "Exit," "Save" and "Back" buttons or options, among others.

Figure 7D:
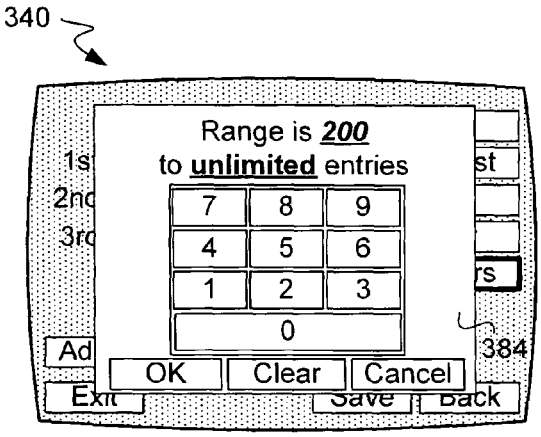

As shown in FIG. 7C, an "Ultimate Prize" setting box can be selected, whereby a new prize setting can be entered and/or the existing or default setting may be edited. Upon selection of such an Ultimate Prize setting box, a screen overlay may be called up, such as the screen overlay 384 depicted on screen 340 of FIG. 7D. Such a screen overlay 384 may provide an opportunity for a number of adding or editing functions. As shown in FIG. 7D, the screen overlay 384 can present an opportunity to enter or adjust a range of ticket entries that correspond to the selected prize level. In such an instance, a virtual numerical keypad or other suitable input mechanism may be provided. As shown, the present ticket entry range setting for the Ultimate Prize level spans from 200 to an unlimited number of ticket entries. Either end of the range may be selected for editing, such as, for example, a reduction of the lower threshold from 200 to 100 ticket entries. In the particular event of an Ultimate Prize, any editing of the "unlimited" upper threshold can be made to result in the creation of a new Ultimate Prize level, whereby the presently edited level then becomes the last intermediate prize level prior to the new ultimate prize level. Such a result may be more user friendly, particularly where operators know that an adjustment to the "unlimited" upper threshold status will result in the creation of a new prize level.

Figure 7E:
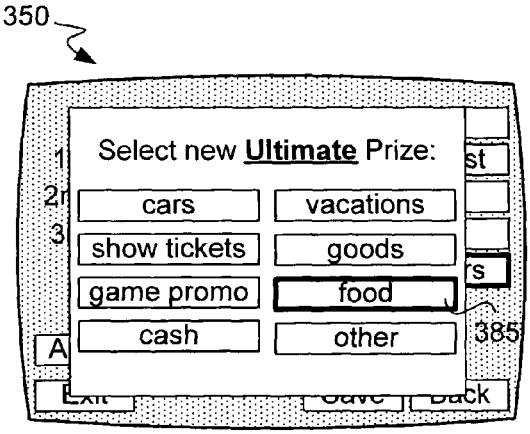
Figure 7F:
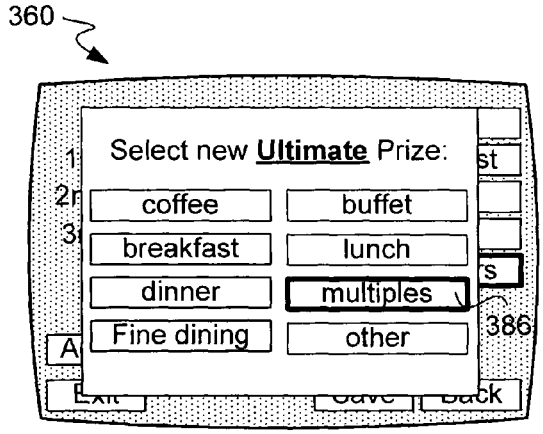

Further features of a screen overlay 384 for a selected input or editable item 383 are shown in FIGS. 7E and 7F. At screen 350 of FIG. 7E, another screen overlay component permits a user or operator to adjust the actual prize to be awarded for a given prize level. Various exemplary prize categories are provided, with one being a "food" category button 385. Upon a selection of a prize category, further detailed prizes can be presented, such as those shown at screen 360 of FIG. 7F. As shown, a plurality of more detailed buttons pertaining to "food" prizes are provided in yet another screen overlay, including a "multiples" button 386. Selection or clicking of such a multiples button may simply increase the current prize incrementally, or may give way to yet another detailed screen overlay with further selection buttons, as will be readily appreciated. As shown, a selection or click of the multiples button 386 may result in the Ultimate Prize being increased from 2 free dinners or "Dinner for 2" to 3 or 4 free dinners, as desired. Of course, a wide variety of additional items and types of items may be provided, as well as additional details, such as the type of dinner and/or the restaurant or dinner location.

It will be readily appreciated that while the specific "Drawing Setup" illustrative examples provided herein can be relatively user friendly, other options and programs can also be provided to adjust and edit such default and readily available selections and settings. For example, a "Maintenance" category may be available to high level operators, with such a category providing further access to create and/or edit the various user friendly selections that can be made available to any other user who is able to access the "Drawing Setup" category, as will be readily appreciated. Of course, such a user friendly graphical user interface is ultimately not necessary for the provision of the various inventive ticket drawings and ticket drawing bonus games disclosed herein, but may be particularly useful if and where it may be implemented.

Whether a graphical user interface or some other form of input is used, various specific drawing setting can include, for example, a Drawing Name, a Drawing Interval, a Drawing Start Date and Time, a Drawing End Date and Time, a Qualifier List, a Prize List, and an Add Prize option, among others. Such an add prize can involve adding a new prize to the prize list defining the prize name and ticket entry quantity thresholds. Other settings that can also be provided regardless of the form of input interface used can include a Commercial Interval, which is the set time interval for the amount of idle time or other definition of time that must pass before the central server can provide a commercial to display. Alternatively, a commercial or other video segment other than the game can be configured to show intermittently on the display regardless of any idle or other defined period of time.

Figure 8:
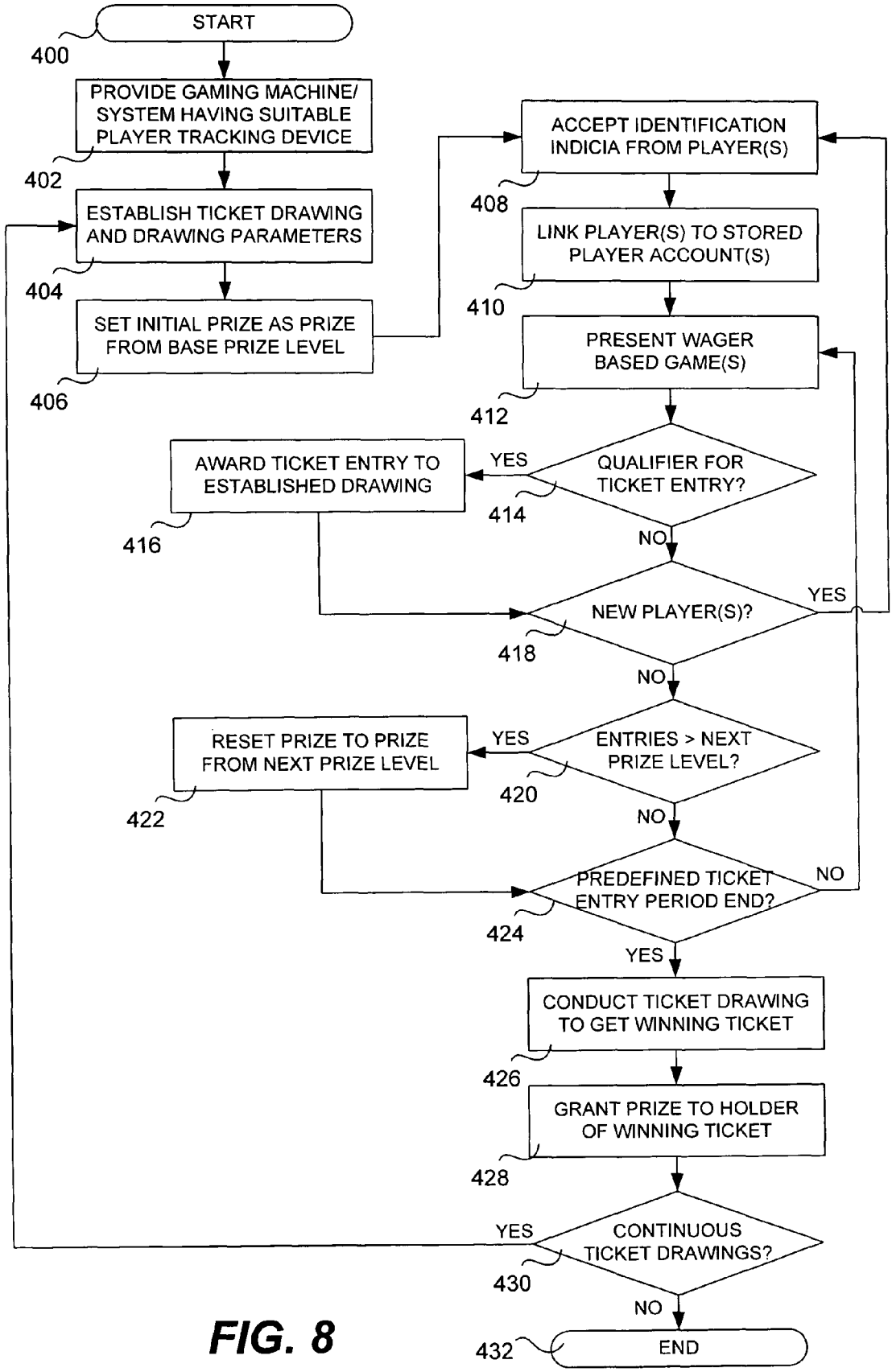
FIG. 8 illustrates a flowchart of an exemplary method of facilitating a ticket drawing within a gaming environment including wager based games according to one embodiment of the present invention.

Turning lastly to FIG. 8, a flowchart conveying an exemplary method of facilitating a ticket drawing within a gaming environment including wager based games according to one embodiment of the present invention is shown. While this flowchart may be comprehensive in some respects, it will be readily understood that not every step provided is necessary, that other steps can be included, and that the order of steps might be rearranged as desired by a given gaming operator. After start step 400, a gaming machine, terminal, system or other relevant gaming device having a suitable player tracking device is provided at a process step 402. While such a device can be a gaming machine 10 having a player tracking device with a video display, as discussed above, it will also be understood that a wide variety of suitable items having a player tracking device adapted to interface with a player tracking system and/or an automated ticket drawing module may be used.

At subsequent process step 404, a ticket drawing is established, including the establishment of various ticket drawing parameters. Such parameters can include the number of different escalating prize levels, the actual prize for each corresponding prize level, a predefined time or event for triggering the actual ticket drawing, and a period for the acceptance of ticket entries, with such an acceptance period including a predefined start and a predefined end. As noted previously, the various escalating prize levels can include a base prize level and a plurality of subsequent prize levels, where such subsequent prize levels can include one or more intermediate prize levels and/or an ultimate prize level. At a following process step 406 the initial prize is set at the specific prize designated as the base level prize, and at process step 408 various identification indicia are accepted from one or more players. Such indicia can include magnetic stripe player tracking cards, for example. Said player or players can then be linked to respective player account or accounts at a player tracking server at process step 410 for player tracking and data collection purposes.

At subsequent process step 412, one or more wager based games are presented, such as at an associated gaming machine or table game. At a following decision step 414, an inquiry is made as to whether a qualifying event or outcome of the wager based game or games has taken place. If so, then the method moves to process step 416, where a ticket entry to the established ticket drawing is awarded to the appropriate player, after which the method continues to decision step 418. If no such qualifier has occurred, then the method simply continues to decision step 418, where an inquiry is made as to whether any new players have begun to participate in activities associated with the established ticket drawing. If so, then the method reverts back to process step 408 to require identifying indicia from the new player or players, whereupon the intervening steps are then repeated. If not, however, then the method continues to decision step 420.

At decision step 420, an inquiry is made as to whether the number of ticket entries has reached a threshold amount such that the next prize level has been reached. If so, then the method proceeds to process step 422, where the current prize is reset from the previous prize to the specific prize at the newly reached prize level, after which the method moves to decision step 424. If the number of ticket entries is insufficient to result in such a change, however, then the method simply continues to decision step 424, where an inquiry is made as to whether the predefined ticket entry period has ended. If not, then the method reverts to process step 412 for further play of wager based games and/or any other possible activities that may result in a ticket entry qualifying event. The foregoing process can then be repeated indefinitely during the ticket entry acceptance period.

When the predefined ticket entry period has ended, however, then the method moves from decision step 424 to process step 426, where the actual ticket drawing is conducted. Such a ticket drawing results in the determination of at least one winning ticket, as will be readily appreciated. The method then continues to process step 428, where the appropriate prize is granted to the ticket drawing winner. Such a winner can be the holder of a winning ticket or receipt, or in the case of a fully automated game, can simply be identified as a specific individual player. In such instances, the ability to claim the prize may be contingent upon the person being able to identify himself or herself appropriately, such as by providing his or her player tracking or rewards card associated with the ticket drawing.

At decision step 430 an inquiry is made as to whether a plurality or series of continuous ticket drawings is involved. If so, and if another subsequent ticket drawing is to take place after the one that has just ended, then the method reverts to process step 404 where the next ticket drawing and set of parameters is established. Of course, the parameters may be identical to those of the previous ticket drawing, particularly in the case of a continuous series of hourly drawings, for example. As will be appreciated, the next ticket drawing may be established at process step 404 immediately after the previous actual ticket drawing is conducted at process step 426, such that the actual granting of a prize to the previous winner may overlap with the establishment and beginning of a new ticket drawing. If no continuous or following ticket drawing is to take place at decision step 430, however, then the method ends at end step 432. Again, various details and additional steps may similarly be included, and it is specifically contemplated that many variations of these exemplary methods may also be practiced.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A gaming machine adapted for accepting wagers, playing primary games based on the wagers and granting monetary awards based on the results of the primary games, comprising:

an exterior housing arranged to contain a plurality of internal gaming machine components therein;

a master gaming controller in communication with at least one of said plurality of internal gaming machine components, said master gaming controller being adapted to control one or more aspects of said primary games;

a player tracking device in communication with said master gaming controller and adapted to track both player activity and primary game results at said gaming machine, wherein said player tracking device is further adapted to facilitate the play of a first automated ticket drawing bonus game based at least in part on one or more of said primary game results, said first automated ticket drawing bonus game having a plurality of ticket entries entered during a first ticket entry period of said first automated ticket drawing bonus game that are put into an overall ticket pool from which one or more winning tickets are drawn at random and being structured to have escalating and discrete prize levels in each subsequent respective automated ticket drawing, wherein graduation from at least one of said discrete prize levels to the next prize level requires a plurality of additional ticket entries in the subsequent respective ticket drawing bonus game to said overall ticket pool; and at least one display device in communication with said master gaming controller, said player tracking device, or both, wherein said at least one display device is adapted to display information regarding said first automated ticket drawing bonus game having escalating and discrete prize levels.

2. The gaming machine of claim 1, wherein said first automated ticket drawing bonus game is conducted with respect to said gaming machine and a plurality of additional gaming machines distributed across a gaming network.

3. The gaming machine of claim 1, wherein one or more ticket entries to said first automated ticket drawing bonus game are granted based on one or more particular outcomes of said primary games.

4. The gaming machine of claim 3, wherein at least one of said one or more particular outcomes of said primary games are selected from the group consisting of 3-of-a-kind, straight, flush, full house, 4-of-a-kind, straight flush, 2 matching reel symbols, 3 matching reel symbols, 10 coin payout, 20 coin payout, 50 coin payout and 100 coin payout.

5. The gaming machine of claim 1, wherein the prize drawing for said first automated ticket drawing bonus game is scheduled to take place at a particular time regardless of the number of entries at that time.

6. The gaming machine of claim 5, wherein said first automated ticket drawing bonus game comprises a first predefined and scheduled period during which ticket entries may be accepted.

7. The gaming machine of claim 6, wherein said particular time for said prize drawing defines the end of said first predefined and scheduled ticket entry period.

8. The gaming machine of claim 6, wherein said first predefined and scheduled ticket entry period is selected from the group consisting of one hour, one day, one week, one month and one year.

9. The gaming machine of claim 6, wherein said player tracking device is further adapted to facilitate the play of a second automated ticket drawing bonus game based at least in part on one or more of said primary game results, wherein said second automated ticket drawing bonus game comprises a second predefined and scheduled period during which ticket entries may be accepted, and wherein said second predefined and scheduled ticket entry period overlaps at least partially with said first predefined and scheduled ticket entry period.

10. The gaming machine of claim 9, wherein said first automated ticket drawing bonus game comprises an hourly game and wherein said second automated ticket drawing bonus game comprises a daily game.

11. The gaming machine of claim 9, wherein a particular outcome of one of said primary games results in a ticket entry to both of said first and second automated ticket drawing bonus games.

12. The gaming machine of claim 6, wherein said first automated ticket drawing bonus game comprises one game of an ongoing series of continuous automated ticket drawing bonus games, wherein each of a plurality of games in said ongoing series of games begins immediately after a prior game ends and ends immediately before a subsequent game begins.

13. The gaming machine of claim 12, wherein said first automated ticket drawing bonus game comprises an hourly game and wherein said ongoing series of continuous automated ticket drawing bonus games comprises 24 games on a particular day.

14. The gaming machine of claim 1, wherein the prize drawing for said first automated ticket drawing bonus game takes place immediately following a particular predefined triggering event.

15. The gaming machine of claim 14, wherein said predefined triggering event is selected from the group consisting of royal flush, straight flush, 3 or more bars, 1000 coin payout, 10,000 coin payout and linked progressive jackpot.

16. The gaming machine of claim 14, wherein said player tracking device is further adapted to facilitate the play of a second automated ticket drawing bonus game based at least in part on one or more of said primary game results, wherein each of said first and second automated ticket drawing bonus games comprise periods during which ticket entries may be accepted, and wherein said ticket entry period for said second automated ticket drawing bonus game overlaps at least partially with said ticket entry period for said second automated ticket drawing bonus game.

17. The gaming machine of claim 16, wherein a particular outcome of one of said primary games results in a ticket entry to both of said first and second automated ticket drawing bonus games.

18. The gaming machine of claim 1, wherein said escalating and discrete prize levels comprise a base prize level, one or more intermediate prize levels, and an ultimate prize level, wherein graduation from each of said base and one or more intermediate prize levels to the next respective prize level requires a predetermined plurality of additional ticket entries.

19. The gaming machine of claim 1, wherein said display device is adapted to display at least a main display screen containing current bonus game information, a ticket entry creation animation screen, and a ticket prize drawing animation screen.

20. The gaming machine of claim 19, wherein said display device is further adapted to display at least an advertisement screen, a scrolling ticker at an edge of a displayed screen, or both, wherein said scrolling ticker provides current bonus game information.

21. A gaming system adapted for accepting wagers, playing primary games based on the wagers and granting monetary awards based on the results of the primary games, comprising:

one or more master gaming controllers adapted to control one or more aspects of said primary games;

a plurality of gaming terminals, each gaming terminal having at least one input device in communication with one of said one or more master gaming controllers and adapted to accept input regarding the placement of said wagers, the play of said primary games, or both, a player tracking unit adapted to accept identification indicia from players, and at least one display device in communication with said at least one master gaming controller and adapted to display information regarding said primary games; and a player tracking system in communication with each of said player tracking units and adapted to track both player activity and primary game results at each of said plurality of gaming terminals, wherein said player tracking system is further adapted to facilitate a series of automated ticket drawings based at least in part on one or more outcomes of said primary games, wherein one or more of said automated ticket drawings includes a plurality of ticket entries entered during a designated ticket entry period of the respective automated ticket drawing bonus game that are put into an overall ticket pool from which one or more winning tickets are drawn at random and is structured to have escalating and discrete prize levels in each respective automated ticket drawing, wherein graduation from at least one of said discrete prize levels to the next prize level requires a plurality of such additional ticket entries into said overall ticket pool.

22. The gaming system of claim 21, wherein one or more of said display devices of said plurality of gaming terminals are further adapted to display information regarding said automated ticket drawings.

23. The gaming system of claim 22, wherein one or more of said display devices of said plurality of gaming terminals are adapted to display one or more of a main display screen containing current ticket drawing information, a ticket entry creation animation screen, a ticket prize drawing animation screen, an advertisement screen, and a scrolling ticker at an edge of a displayed screen.

24. The gaming system of claim 23, wherein a first display device at a first gaming terminal and a second display device at a second gaming terminal are adapted to display simultaneously first and second screens respectively regarding the same automated ticket drawing, and wherein said first and second screens are substantially different with respect to each other.

25. The gaming system of claim 24, wherein said first screen at said first display device comprises a main display screen containing current ticket drawing information and said second screen at said second display device comprises a ticket entry creation animation screen.

26. The gaming system of claim 21, further including:

at least one additional ticket drawing display device in communication with said player tracking system and adapted to display information regarding said automated ticket drawings.

27. The gaming system of claim 21, wherein the prize drawing for one or more of said automated ticket drawings is scheduled to take place at a particular time regardless of the number of ticket entries at that time.

28. The gaming system of claim 27, wherein a first automated ticket drawing comprises a first predefined and scheduled period during which ticket entries may be accepted.

29. The gaming system of claim 28, wherein said player tracking system is further adapted to facilitate a second automated ticket drawing based at least in part on one or more of said primary game results, wherein said second automated ticket drawing comprises a second predefined and scheduled period during which ticket entries may be accepted, and wherein said second predefined and scheduled ticket entry period overlaps at least partially with said first predefined and scheduled ticket entry period.

30. The gaming system of claim 29, wherein said first automated ticket drawing comprises an hourly drawing and wherein said second automated ticket drawing comprises a daily drawing.

31. The gaming system of claim 29, wherein a particular outcome of one of said primary games results in a ticket entry to both of said first and second automated ticket drawings.

32. The gaming system of claim 28, wherein said first automated ticket drawing comprises one drawing of an ongoing series of continuous automated ticket drawings, wherein the ticket entry period for each of a plurality of ticket drawings in said ongoing series of ticket drawings begins immediately after the ticket entry period for a prior ticket drawing ends and ends immediately before the ticket entry period for a subsequent ticket drawing begins.

33. The gaming system of claim 21, wherein the prize drawing for one or more of said automated ticket drawings takes place immediately following a particular predefined triggering event.

34. The gaming system of claim 21, wherein said escalating and discrete prize levels comprise a base prize level, one or more intermediate prize levels, and an ultimate prize level, wherein graduation from each of said base and one or more intermediate prize levels to the next respective prize level requires a predetermined plurality of additional ticket entries.

35. The gaming system of claim 21, further including:

a separate ticket drawing controller within or at least in communication with said player tracking system and adapted to accept input, facilitate the storage of pertinent information and generate results regarding said automated ticket drawings.

* * * * *